United States Patent [19]

Hasskamp

[11] Patent Number: 4,537,231

[45] Date of Patent: Aug. 27, 1985

[54] DISPENSER APPARATUS FOR SIMULTANEOUSLY DISPENSING PREDETERMINED EQUAL VOLUMES OF LIQUID INCLUDING A DISPOSABLE DISPENSER MODULE

[75] Inventor: Paul R. Hasskamp, Cockeysville, Md.

[73] Assignee: Becton, Dickinson and Company, Paramus, N.J.

[21] Appl. No.: 527,294

[22] Filed: Aug. 29, 1983

[51] Int. Cl.[3] ..... B65B 3/30

[52] U.S. Cl. ..... 141/238; 141/242; 141/28; 141/130; 73/863.32; 73/864.11; 222/263; 422/100

[58] Field of Search ..... 141/1, 23–26, 141/27, 28, 130, 234–238, 240, 242; 422/100; 222/263; 277/167.3, 168–172; 73/864.11, 863.32, 864.25, 864.15, 864.23, 864.24

[56] References Cited

U.S. PATENT DOCUMENTS

| | | | |
|---|---|---|---|
| 2,595,493 | 5/1952 | Slaby et al. | 141/24 |
| 3,162,456 | 12/1964 | Williams | 277/136 |
| 3,568,735 | 3/1971 | Lancaster | 141/238 |
| 3,572,552 | 3/1971 | Guinn | 222/263 |
| 3,650,306 | 3/1972 | Lancaster | 141/238 |
| 3,807,235 | 4/1974 | Lefkovits et al. | 73/863.32 |
| 3,982,089 | 9/1976 | Hyltin | 200/159 B |
| 3,982,438 | 9/1976 | Byrd | 73/863.32 |
| 4,047,438 | 9/1977 | Sekine | 73/864.11 X |
| 4,158,035 | 6/1979 | Haase et al. | 141/26 X |
| 4,444,062 | 4/1984 | Bennett et al. | 73/863.32 |
| 4,461,328 | 7/1984 | Kenney | 141/67 |

*Primary Examiner*—Stephen Marcus
*Assistant Examiner*—Ernest G. Cusick
*Attorney, Agent, or Firm*—Fitch, Even, Tabin & Flannery

[57] ABSTRACT

Dispenser apparatus for simultaneously providing predetermined equal volumes of liquid to each of a plurality of wells. The apparatus includes a disposable multiple chamber dispenser module having a top surface and a plurality of dependent walls each defining a lower chamber for alignment with a corresponding well. Each chamber has an open lower nozzle end and extends upwardly to an opening in the top surface. A die plate having a plurality of concavities is provided with each concavity having an equal volume and a mouth. Each concavity is defined by an inner surface and corresponds to one of the chambers. The apparatus further comprises diaphragm means having a portion extending across the mouth of each concavity. Each diaphragm portion is movable from a first position across the mouth of its concavity to a second position in surface contact with the inner surface defining that concavity. Additionally, the apparatus includes means spacing the diaphragm means from the module top surface and forming upper chamber means which constitutes an upper extension of each lower chamber. Each upper chamber means has a volume that is variable by the position of the diaphragm portion. Finally, the apparatus comprises means for selectively moving each diaphragm portion from a first position to a second position.

1 Claim, 5 Drawing Figures

74
76
79
32
78
82
80
82
52
67
54
64
54
64
72
48
62
48
72
62
46
70
70
67
69
68
68
66
50
60
50
60
56
40
63
63
42
42
38
36
58
44
58
44
36

DISPENSER APPARATUS FOR SIMULTANEOUSLY DISPENSING PREDETERMINED EQUAL VOLUMES OF LIQUID INCLUDING A DISPOSABLE DISPENSER MODULE

BACKGROUND OF THE INVENTION

The present invention relates to apparatus for dispensing a liquid and, more particularly, to a dispensing apparatus for simultaneously dispensing predetermined equal volumes of liquid to a plurality of receivers.

Particularly in the field of microbiology, there is need to determine the results of adding different ingredients, such as drugs, or varying quantities of the same ingredient, to equal volumes of the same liquid, such as a microbiological broth in which bacteria have been grown. A common method of carrying out such a test is to use a tray having an array of wells each having an equal volume of liquid and adding the various ingredients. It will be appreciated that manually placing the liquid in each well is time consuming, expensive, and tends to introduce inaccuracies.

Prior art apparatus for simultaneously dispensing like volumes of liquid to an array of wells is shown in FIGS. 1 and 2. The apparatus includes a standard 20, supported by a base 22, releasably carrying a horizontally extending dispenser module 24 having an apertured top surface with dependent walls 26 each forming a dispenser chamber 28 in alignment with a corresponding well. Clamped in sealed relationship across the module top surface is a diaphragm 29; a horizontal plate 30 having a downwardly extending arrangement of plungers 31 overlies the module, each plunger being in registration with a corresponding dispenser chamber and each being exactly the same size. Plate 30 is manually movable toward and away from the dispenser module by means a rack and pinion drive. Operation of the drive causes the plungers to deflect downwardly diaphragm portions, to reduce the volume of each dispenser chamber by an equal amount as shown in FIG. 2. After the lower or nozzle ends of walls 26 are inserted in a pan of liquid beneath the liquid level, retraction of the plunger plate permits the diaphragm, due to its resiliency, to return to its FIG. 1 position, thus drawing an equal volume of the liquid into each dispenser chamber. Replacement of the pan with the tray and operation of the drive effects release of the liquid from the dispenser chambers into the wells.

The diaphragm is integrally clamped to the dispenser module, and both are replaced after each use because the module is contaminated by the liquid. Another reason the diaphragm is replaced after each use is that, as diaphragm portions enter the chambers, the diaphragm may be contaminated by the liquid. This prior art system requires an expensive drive and alignment slide to maintain the precise horizontal posture of the plate as it moves from its retracted position. Movement of the plate out of a horizontal plane results in unequal volumes of liquid being drawn into the various dispenser chambers. Additionally, as the drive is manually operable, operator judgment is required in determining when the plunger plate has reached its fully extended position. For example, if the operator makes a mistake due to inattentiveness or attempting to operate the apparatus too quickly, while equal volumes will be introduced into each dispenser chamber, such volumes will be less than the predetermined desired volumes, possibly rendering the test results invalid.

SUMMARY OF THE INVENTION

Among the several objects of the present invention may be noted the provision of an improved liquid dispenser system; the provision of such system which avoids contamination by the liquid except for one inexpensive, disposable component; the provision of such system which provides each of a plurality of receivers with an equal, predetermined volume of liquid; the provision of such system which avoids the use of mechanical drivers requiring operator judgment in use; and the provision of such system which is reliable in use, has long service life (apart from the inexpensive, disposable component) and is simple and economical to manufacture. Other objects and features will be in part apparent and in part pointed out hereinafter in the specification and attendant claims.

Briefly, the dispenser apparatus of the present invention includes a disposable multiple chamber dispenser module, a die plate, diaphragm means, means spacing the diaphragm means from the module, and means for selectively moving the diaphragm portions. The dispenser module has a top surface and a plurality of dependent walls each defining a lower chamber with each chamber having an open lower nozzle end and extending upwardly to an opening in the top surface. The die plate has a plurality of concavities each of an equal volume and each having a mouth. Each concavity is defined by an inner surface and corresponds to one of the chambers. The diaphragm portions extend across the mouth of each concavity with each portion being movable from the mouth of its concavity into substantially full surface contact with the inner surface defining its corresponding concavity. The spacing means forms, in part, upper chamber means which constitutes an upper extension of each lower chamber. Each upper chamber has a predetermined volume which determines upward travel of the diaphragm and thus determines the dispense volume.

BRIEF DESCRIPTION OF THE DRAWINGS

Corresponding reference characters indicate corresponding components throughout the several drawings of the present invention.

DESCRIPTION OF THE PREFERRED EMBODIMENTS

Figure 2:
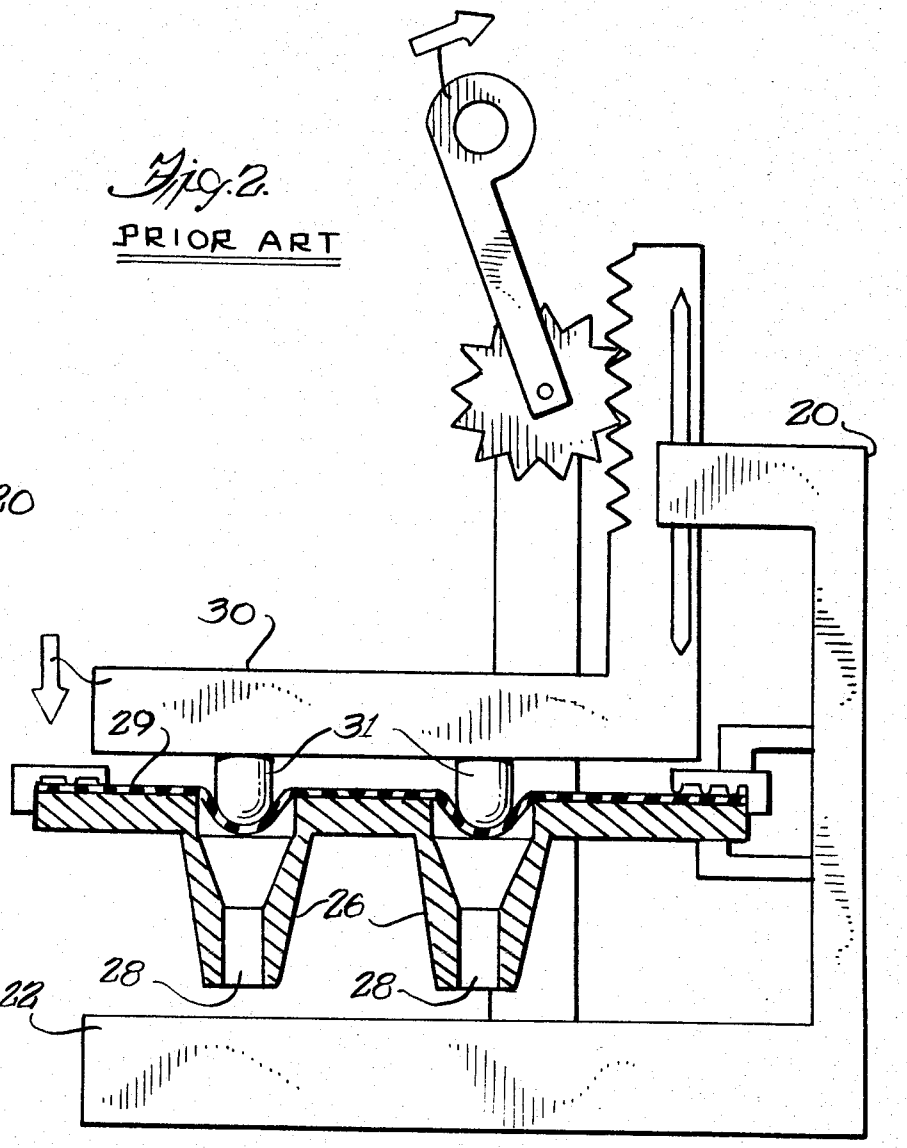
Fig. 2. PRIOR ART
FIG. 2, similar to FIG. 1, shows the prior art dispenser with its plunger assembly in its extended position preparatory to filling the chambers with liquid.
Figure 1:
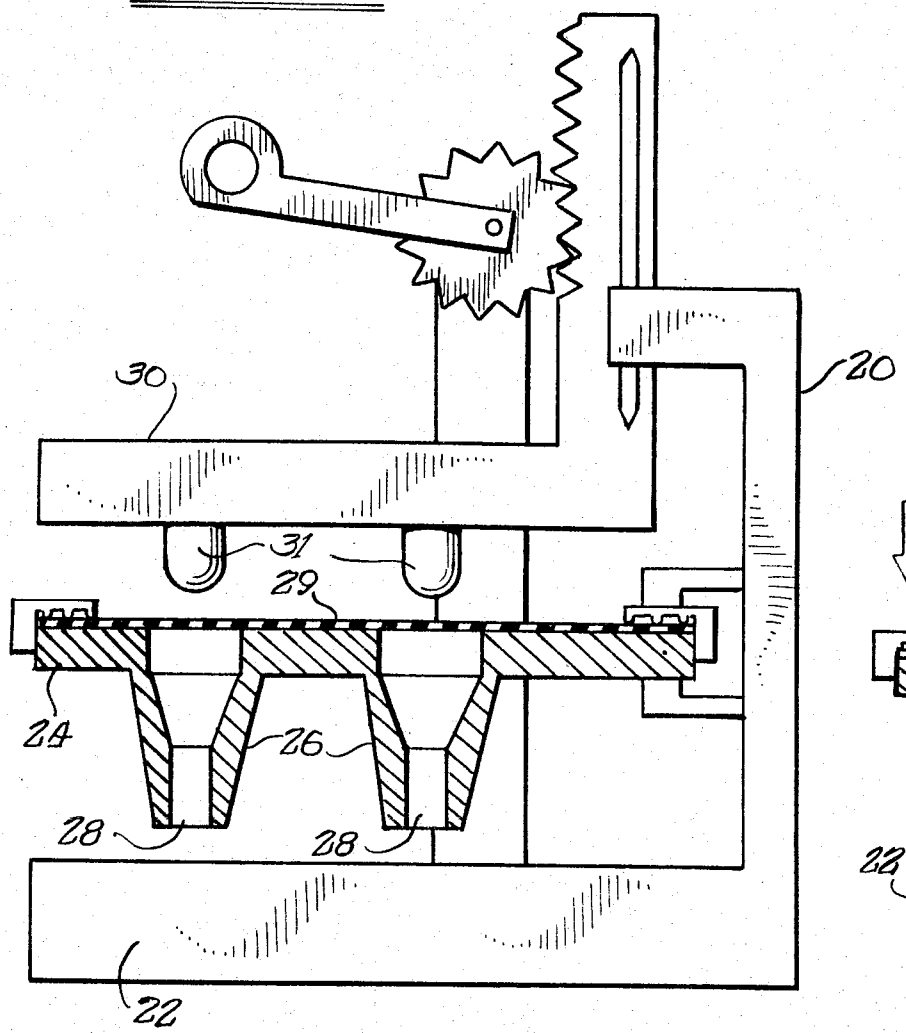
Fig. 1 PRIOR ART
FIG. 1 is a side elevational view, partly in section, showing a prior art multiple chamber dispenser system with its plunger assembly moving toward its retracted position prior to filing.
Figure 3:
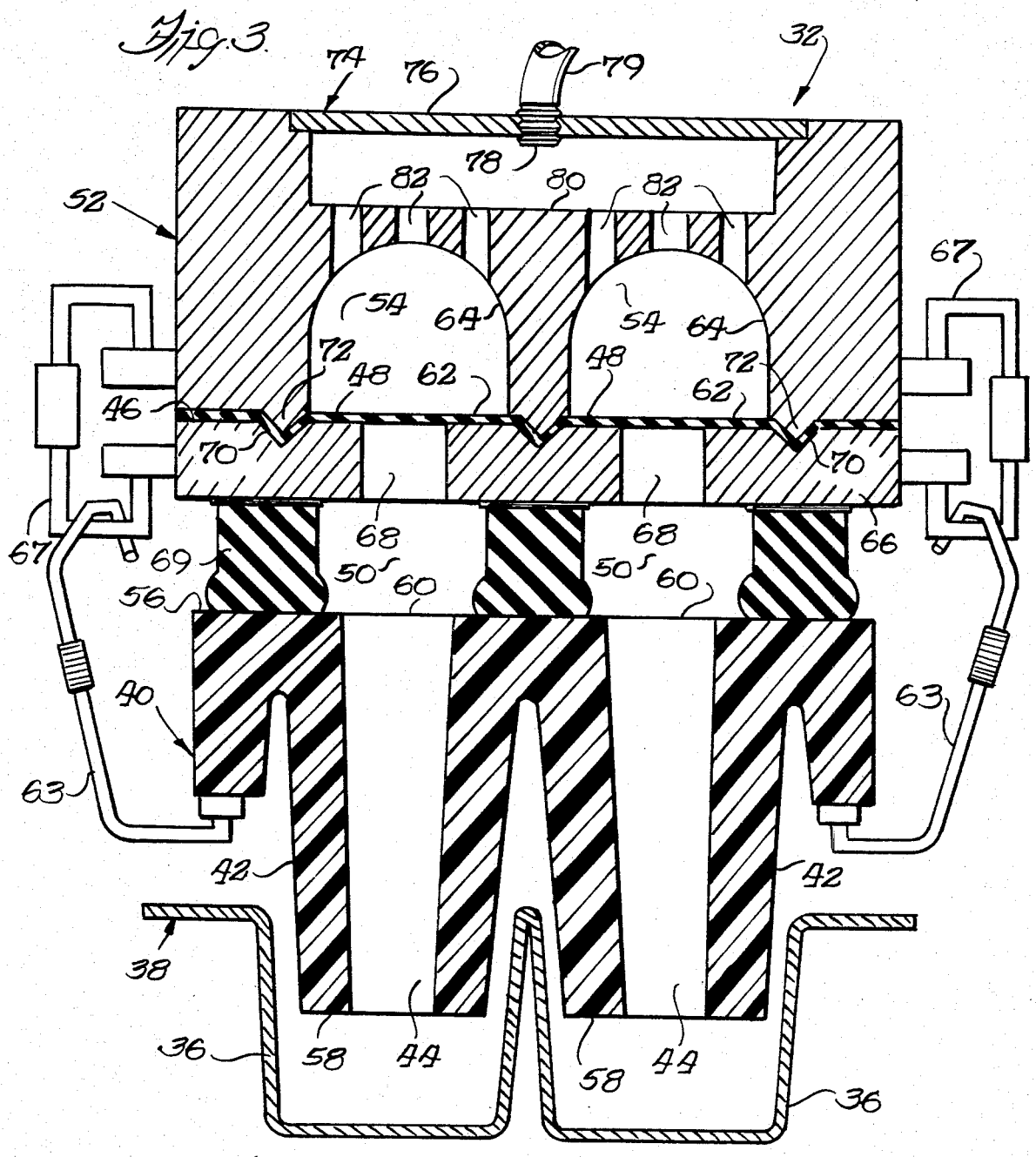
FIG. 3 is a sectional view of one embodiment of the multiple chamber dispenser system of the present invention illustrating a diaphragm for use in filling the chambers in its relaxed condition.
Figure 4:
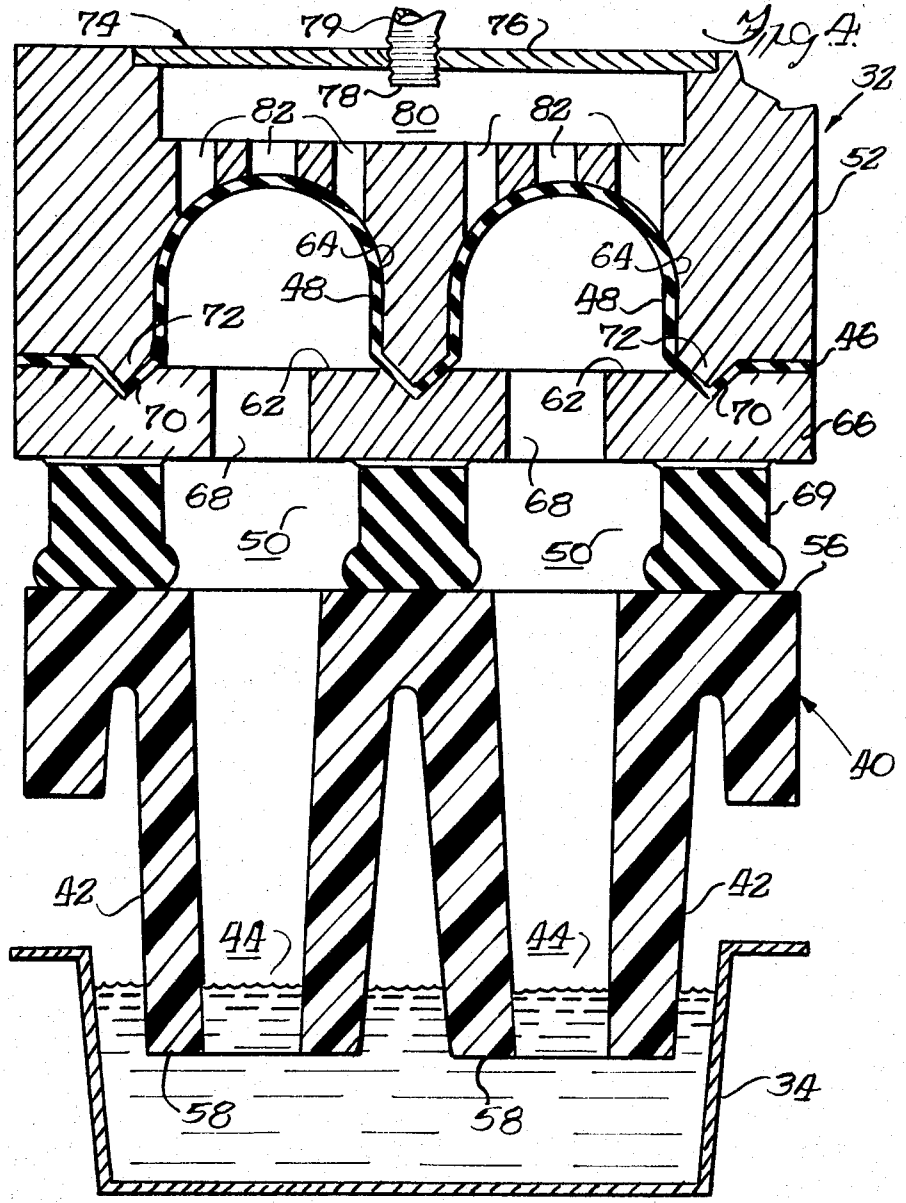
FIG. 4, similar to FIG. 3, depicts portions of the diaphragm drawn from their relaxed conditions by application of a vacuum to effect filling of the cavities.

Referring now to FIGS. 3 and 4, a preferred embodiment of the multiple chamber dispenser apparatus of the present invention is generally indicated by reference numeral 32. Dispenser apparatus 32 is useful for withdrawing a plurality of equal volumes of a liquid from a container such as a pan 34 (FIG. 4) and dispensing the volumes in separate wells 36 of a tray 38 (FIG. 3). Included in apparatus 32 are a disposable dispenser module 40 having dependent walls 42 forming lower chambers 44 to receive the liquid, a diaphragm 46 having a portion 48 which is movable to change the volume of an upper chamber 50 which constitutes an upper extension of each lower chamber; and a die plate 52 having a concavity 54 for receiving each diaphragm portion to change the volume of each upper chamber by an equal amount.

More specifically, disposable dispenser module 40 is preferably formed of an inexpensive plastic material, such as polystyrene, and has a top surface 56 and a plurality of the dependent walls 42 each forming a lower chamber 44 with each chamber arranged to match the placement of a well 36 in tray 38. Although only two chambers are shown in the drawings, it will be appreciated that such an arrangement is merely for purposes of illustration. A common arrangement of wells in a tray is twelve rows of seven wells each. Each chamber 44 has a lower nozzle end 58 with an orifice, and the top surface 56 has an opening 60 above each chamber 44.

The concavities 54 of die plate 52 have equal volumes and each has a lower mouth 62. Each concavity 54 is preferably dome-shaped and is defined by an inner surface 64, and each corresponds to one of the dispenser chambers 44. Diaphragm 46 has a portion 48 extending across the mouth 62 of each concavity 54. Portions 48 are movable between a first position wherein they extend in a generally relaxed, planar posture across the mouths (FIG. 3), and a second position wherein they are in substantially full surface contact with inner surfaces 64 defining the concavities 54.

As shown in FIGS. 3 and 4, diaphragm 46, preferably made of synthetic rubber, is disposed between die plate 52 and dispenser module 40. Positioned between the diaphragm and dispenser module is a clamping plate 66 which, in part, constitutes means spacing the diaphragm 46 from the top surface of module 40 and forms, in part, upper chambers 50. Clamping plate 66 has an aperture 68 underlying each diaphragm portion 48 and communicating with a corresponding chamber 44. Clamps 67 are provided firmly to hold die plate 52 and clamping plate 66 together with the diaphragm disposed therebetween. Bonded to the bottom surface of clamping plate 66 for entering into a sealing relationship with the top surface 56 of dispenser module 40 is an apertured gasket sheet 69 for isolating upper chambers 50 from one another. Thus each corresponding upper chamber 50 and lower chamber 44 is only open through the orifice at the nozzle end 58 of closed wall 42.

The top surface of clamping plate 66 has grooves 70, triangular in section, about each aperture 68. Similarly, die plate 52 has projections 72 encompassing each concavity 54 and shaped complementary to the grooves 70 so that upon clamping of the clamping plate 66 to die plate 52 with the diaphragm 46 disposed therebetween, each diaphragm portion 48 becomes sealed about its periphery.

Dispenser apparatus 32 also includes means for selectively moving each diaphragm portion 48 between a first position wherein it is disposed in a generally relaxed planar condition extending across the mouth 62 of its concavity 54 (FIG. 3), and a second position wherein it is in substantially full surface contact with the inner surface 64 of the concavity thereby increasing the volume of its upper chamber 50 by a fixed amount corresponding to the volume of the concavity. For this purpose dispenser apparatus 32 has vacuum means comprising a manifold 74 formed in the upper surface of die plate 52. The manifold 74 is closed by a plate 76 which has an exit port 78 that receives a line 79 leading to a source of vacuum. When connected to such a vacuum source, the manifold becomes a main vacuum chamber 80 communicating with each concavity 54 by means of one or more of passageways 82 intersecting each concavity inner surface 64. The vacuum generator and attendant valve means and lines for connection to port 78 are well known to those of skill of the art and, in the interests of brevity, are not shown. Suffice it to say that pulling of a vacuum on port 78 withdraws air from concavities 54 moving diaphragm portions 48 to their second positions (FIG. 4), while operation of the valve means to connect port 78 to atmosphere results in return of the diaphragm portions to their first positions extending across the mouths 62 of the concavities 54.

Operation of the dispenser apparatus 32 of the present invention is as follows: After assembly of disposable dispenser module 40 to the remainder of the apparatus by clamps 63 so that gasket sheet 69 enters into sealing relationship with the top surface 56 of the disposable dispenser module 40, the module is lowered or otherwise inserted into a pan 34 containing the liquid to be dispensed with nozzle ends 58 disposed at least a predetermined distance below the liquid level. Operation of the vacuum means then moves diaphragm portions 48 to their second positions causing an equal, predetermined amount of liquid to be drawn into each lower chamber 44. The application of vacuum is maintained while the pan is replaced with the tray, and operation of the valve means to connect port 78 to the atmosphere then causes diaphragm portions 48 to return to their first positions dispensing an equal amount of liquid to each well 36 in tray 38. Of course, the valve means incorporates the necessary orifices and delays to prevent rapid movement of the diaphragm portions which might result in splashing of the liquid. The disposable dispenser module 40 is released from the remainder of the dispenser apparatus, discarded and replaced with a fresh module placing the dispenser apparatus in condition to fill the wells of a subsequent tray.

The only component of the apparatus requiring replacement after each use is the inexpensive dispenser module. Unlike the prior art dispenser, the diaphragm is not attached to the module, and in all positions, the diaphragm portions remain well spaced from the liquid to preclude contamination of the diaphragm due to a slight splashing or sloshing. Accordingly, apparatus 32 is much more economical in use because it avoids constant replacement of the relatively expensive diaphragm. Additionally, the dispenser apparatus 32 of the present invention is extremely accurate in delivering equal, predetermined volumes of the liquid. It avoids the precise alignment requirements of the prior art dispenser having mechanical drives wherein canting of the plunger plate from a horizontal plane could result in unequal volumes of liquid being dispensed. The present apparatus also avoids the requirement of the potential exercise of operator judgment in determining completion of the full stroke of the mechanical drive. Completion of less than a full stroke results in dispensing of equal liquid amounts, but less than the predetermined amount.

Figure 5:
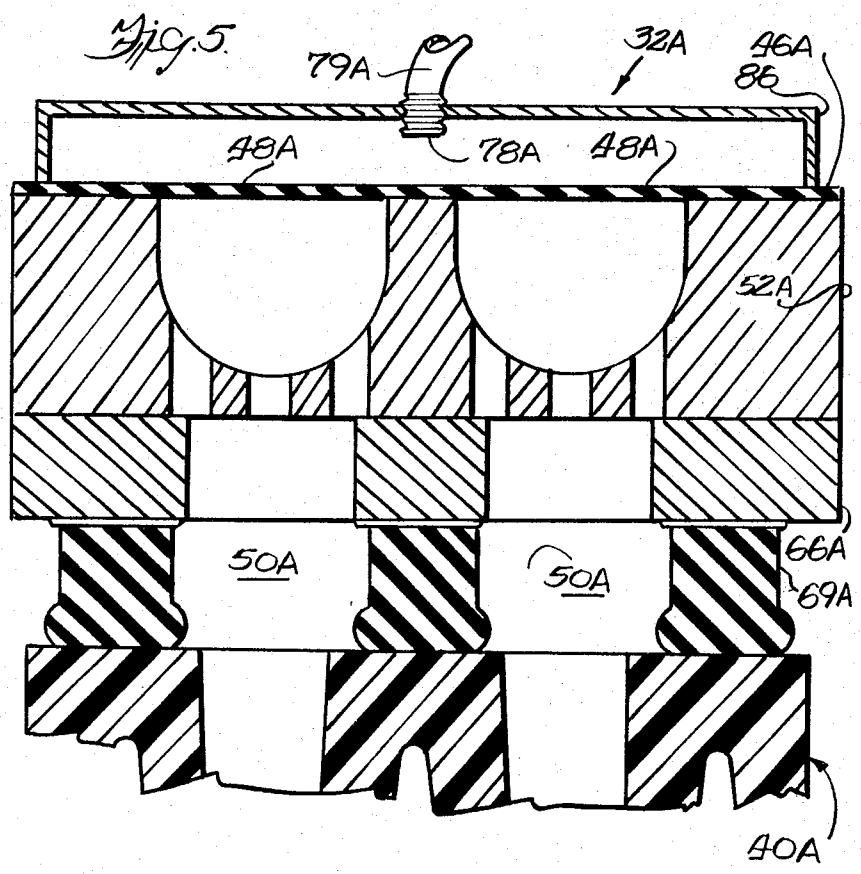
FIG. 5 illustrates an alternate embodiment of the present invention wherein the diaphragm portions are deflected from their relaxed conditions by application of pressurized fluid.

An alternative embodiment of the dispenser apparatus of the present invention is generally indicated in FIG. 5 by reference character 32A. Components of dispenser 32A corresponding to those of dispenser 32 are identified by the use of the reference numeral assigned to the component of dispenser 32 with the addition of the suffix "A". The operational philosophy of dispenser 32A is identical to that of dispenser 32, except the application of a pressurized fluid, e.g., air, is used to move the diaphragm portions. In the alternative embodiment, the die plate 52A can be generally considered to be inverted, with the die plate disposed between diaphragm 46A and dispenser module 40A. Additional components of this embodiment include the apertured resilient sealing sheet 69A, a spacer plate 66A, which is optional, and a manifold cover 86 attached in sealing relationship to the upper surface of diaphragm 46A. An apertured clamping plate (not shown) could be optionally provided above the die plate 52A to clamp the diaphragm thereto. The pressurized fluid generator, valve means and lines connected to exit port 78A are well known to those of skill in the art and are not shown. Suffice it to say that the application of pressure to diaphragm portions 48A pushes them to their second portions thereby reducing the volume of each upper chamber 50A by an equal amount. Subsequently, venting or exhaustion through exit port 78A effects return of the diaphragm portions to their first positions drawings equal amounts of liquid into each lower chamber. The operation of dispenser apparatus 32A is generally similar to that previously described with reference to dispenser apparatus 32, except in the alternative embodiment the dispenser chambers receive liquid during movement of the diaphragm portions from their second or extended positions to their first or relaxed positions, and dispense the liquid in response to return of the diaphragm portions to their extended positions.

Referring to FIGS. 3–5, these drawings are representative of a scale in which the spacing between the axes of adjacent wells 36 is approximately ten millimeters, each well has a diameter of approximately seven millimeters and the volume of each concavity 54 is approximately 100 microliters.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Dispenser apparatus for simultaneously providing predetermined equal volumes of liquid to each of a plurality of wells, said apparatus comprising:

a disposable multiple chamber dispenser module of integral plastic construction having a top surface and a plurality of dependent walls each defining a lower chamber for alignment with a corresponding well, each chamber having an open lower nozzle end and extending upwardly to an opening in said top surface;

a die plate having a plurality of concavities each having an equal volume and a mouth, and each being defined by an inner surface and corresponding to one of said chambers;

a diaphragm having a portion extending across the mouth of each concavity, each said portion being movable from said mouth into substantially full surface contact with said inner surface, means for spacing said diaphragm from said top surface and forming an upper chamber which constitutes an upper extension of each lower chamber, said upper chamber having a volume that is variable by the position of said diaphragm portion; and means for moving each diaphragm portion between a first position across the mouth of its concavity and a second position wherein it is in surface contact with said inner surface, whereby the volume of each upper chamber can be changed by the same amount by selective operaton of said means for moving, said diaphragm being disposed between said die plate and said dispenser module and wherein said means for moving comprises means for providing a vacuum, said means for providing a vacuum including a vacuum manifold on said die plate, each inner surface having a plurality of vacuum openings, said means for spacing comprising a clamping plate disposed between said diaphragm and said dispenser, said clamping plate having a bottom surface, said dispenser apparatus further comprising means for sealing for forming air tight seals with the top surface of said dispenser module including a gasket sheet bonded to said bottom surface of said clamping plate to enter into a sealing relationship with said top surface of said dispenser module, said gasket sheet having an aperture in alignment with each upper chamber and its corresponding lower chamber so that the upper chambers are isolated from one another, the material of said gasket sheet not overlying any of said lower chambers, said dispenser module further including a dependent peripheral skirt terminating in a lower abutment surface for engagement by a clamp, said clamping plate also comprising an abutment surface for engagement by said clamp, said clamping plate having a first surface facing said diaphragm and said die plate has a second surface facing said diaphragm, one of said first and second surfaces having grooves and the other of said first and second surfaces having corresponding projections, the projections pushing components of said diaphragm into said grooves.

* * * * *

UNITED STATES PATENT AND TRADEMARK OFFICE

CERTIFICATE OF CORRECTION

PATENT NO. : 4,537,231

DATED : August 27, 1985

INVENTOR(S) : Paul R. Hasskamp

It is certified that error appears in the above-identified patent and that said Letters Patent is hereby corrected as shown below:

Column 1, line 39, insert --of-- between "means" and "a".

Column 2, line 44, change "dispense" to --dispenser--.

Column 5, line 38, change "drawings" to --drawing--.

Column 6, line 29, change "operaton" to --operation--.

Signed and Sealed this

*Thirty-first* Day of *December 1985*

[SEAL]

*Attest:*

DONALD J. QUIGG

*Attesting Officer*

*Commissioner of Patents and Trademarks*